US010509338B2

(12) United States Patent
Sakurada et al.

(10) Patent No.: US 10,509,338 B2
(45) Date of Patent: Dec. 17, 2019

(54) TWO-COMPONENT DEVELOPER FOR DEVELOPING ELECTROSTATIC LATENT IMAGE

(71) Applicant: Konica Minolta, Inc., Tokyo (JP)

(72) Inventors: Ikuko Sakurada, Hachioji (JP); Satoshi Uchino, Hino (JP); Shinya Obara, Fuchu (JP); Futoshi Kadonome, Sagamihara (JP); Keiji Arai, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/214,859

(22) Filed: Dec. 10, 2018

(65) Prior Publication Data

US 2019/0243272 A1 Aug. 8, 2019

(30) Foreign Application Priority Data

Feb. 8, 2018 (JP) ..... 2018-020588

(51) Int. Cl.

| | |
|---|---|
| ***G03G 9/097*** | (2006.01) |
| ***G03G 9/08*** | (2006.01) |
| ***G03G 9/113*** | (2006.01) |
| ***G03G 9/087*** | (2006.01) |
| ***G03G 5/147*** | (2006.01) |

(52) U.S. Cl.

CPC ..... *G03G 9/09716* (2013.01); *G03G 5/14704* (2013.01); *G03G 9/0819* (2013.01); *G03G 9/0823* (2013.01); *G03G 9/08711* (2013.01); *G03G 9/08755* (2013.01); *G03G 9/09725* (2013.01); *G03G 9/1133* (2013.01)

(58) Field of Classification Search

CPC ..... G03G 9/09708; G03G 9/09716; G03G 9/09725; G03G 9/1133

See application file for complete search history.

(56) References Cited

U.S. PATENT DOCUMENTS

2001/0051270 A1* 12/2001 Yamashita ..... B82Y 30/00 428/405
2016/0209770 A1* 7/2016 Nakamura ..... G03G 9/1133

FOREIGN PATENT DOCUMENTS

| | | | |
|---|---|---|---|
| JP | 11-7149 | A | 1/1999 |
| JP | 2009192722 | A | 8/2009 |
| JP | 2009265471 | A | 11/2009 |

* cited by examiner

*Primary Examiner* — Janis L Dote
(74) *Attorney, Agent, or Firm* — Lucas & Mercanti, LLP

(57) ABSTRACT

Provided is a two-component developer for developing an electrostatic latent image containing: toner particles having toner mother particles and an external additive on a surface of the toner mother particles; and carrier particles, wherein the external additive contains alumina particles; the alumina particles are subjected to a surface modification with a hydrophobilizing agent; among the hydrophobilizing agent existing on the surface of the alumina particles after the surface modification, a ratio of the hydrophobilizing agent in a state of being liberated from the surface is 20% or less when extraction treatment is performed under a predetermined condition; the alumina particles have a number average primary particle diameter in the range of 5 to 60 nm; and the carrier particles have a resin covering layer, and the resin covering layer is formed with an alicyclic (meth)acrylate monomer.

9 Claims, No Drawings

TWO-COMPONENT DEVELOPER FOR DEVELOPING ELECTROSTATIC LATENT IMAGE

Japanese Patent Application No. 2018-020588, filed on Feb. 8, 2018 with Japan Patent Office, is incorporated herein by reference in its entirety.

TECHNICAL FIELD

The present invention relates to a two-component developer for developing an electrostatic latent image. More specifically, the resent invention relates to a two-component developer for developing an electrostatic latent image which is capable of suppressing variations of charge amount of toner and obtaining high quality images for a long period of time.

BACKGROUND

A role of an external additive of the electrostatic latent image developing toner (hereinafter also simply referred to as "toner"), is improvement in chargeability and fluidity may be mentioned, for example. Generally, the external additive is a fine powder of an inorganic oxide, and silica particles, titania particles, and alumina particles are used. Although silica particles are effective for improving fluidity, there is a problem that the charge amount of the toner is excessively increased especially in a tow temperature and low humidity environment clue to high negative chargeability.

Therefore, means for imparting the effect of suppressing the charge amount in a low-temperature and low-humidity environment is known by using silica particle in combination with titania particles having low electric resistance (hereinafter simply referred to as resistance). However, since titania particles have low resistance so that there is a problem that the charge transfer of the carrier particles is promoted and the charge amount of the toner is lowered when transferred to carrier particles during high coverage printing.

Therefore, it is known to increase the amount of the surface modifying agent of the titania particles in order to have the same degree of resistance as the carrier particles. However, in order to make the titania particles have the same degree of resistance as the carrier particles, the surface modification amount becomes excessive. When the excessive surface modifying agent is liberated, the modifying agents aggregate with each other, the fluidity is deteriorated, and there is a problem that the charge amount of the toner is lowered.

As an external additive, it is also known to use alumina particles having higher resistance than titania particles and lower resistance than silica particles. For alumina particles, for example, it is known to use a hydrophobilized material (see Patent documents 1 and 2: JP-A 2009-265471 and JP-A 2009-192722). However, with the conventional method using alumina particles, it was impossible to stabilize the fluctuation of the charge amount at the time of high coverage While securing the fluidity of the toner. There is also known a method using a developer containing a toner containing toner particles to which alumina particles are externally added and carrier particles coated with a thermosetting straight silicone resin (see Patent document 3: JP-A 11-7149). However, since the heat-cured straight silicone resin has high hygroscopicity, there is a problem that it is impossible to sufficiently suppress the fluctuation of the charge amount due to the environment.

SUMMARY

The present invention was done based on the above-described problems and situations. An object of the present invention is to provide a two-component developer for developing an electrostatic latent image capable of suppressing variations of charge amount of toner and producing high quality images for a long period of times.

In order to solve the above-mentioned problem, the present: inventors examined the causes of the above problems. As a result, it was found that a specific two-component developer for developing an electrostatic latent image is capable of suppressing variations of charge amount of toner and producing high quality images for a long period of times. This specific two-component developer contains a toner including: carrier particles having a resin covering layer formed with an alicyclic (meth)acrylate monomer; and alumina particles as an external additive having a predetermined number average particle diameter and subjected to a surface modification with a hydrophobilizing agent under a predetermined condition. Thus the present invention has been achieved. Namely, the object of the present invention is solved by the following embodiments.

A two-component developer reflecting an aspect of the present invention is a two-component developer for developing an electrostatic latent image comprising: toner particles having toner mother particles and an external additive on a surface of the toner mother particles; and carrier particles, wherein the external additive contains alumina particles, the alumina particles are subjected to a surface modification with a hydrophobilizing agent, among the hydrophobilizing agent existing on the surface of the alumina particles after the surface modification, a ratio of the hydrophobilizing agent in a state of being liberated from the surface is 20% or less when extraction treatment is performed under a predetermined condition, the alumina particles have a number average primary particle diameter in the range of 5 to 60 nm, and the carrier particles have a resin covering layer, and the resin covering layer is formed with an alicyclic (meth)acrylate monomer.

DETAILED DESCRIPTION OF THE EMBODIMENTS

According to the present invention, it is possible to provide a two-component developer for developing an electrostatic latent image which is capable of suppressing variations in charge amount of toner and obtaining high quality images for a long period of time.

A formation mechanism or an action mechanism of the effects of the present invention is not clearly identified, but it is supposed as follows. The toner according to the present invention uses alumina particles as an external additive. The alumina particles have higher resistance than titania particles and have tower resistance than silica particles. Further, the alumina particles according to the present invention have been surface-modified with a hydrophobilizing agent. Among the hydrophobilizing agents existing on the surface after the surface modification, the ratio of the hydrophobilizing agent in a state of being liberated from the surface when extracting under a predetermined condition is 20% or less. Thus, by covering the alumina particles with an appropriate amount of the surface modifier, it is presumed that alumina particles could have the same degree of resistance as the carrier particles. Further, by setting the particle size of the alumina particles in the range of 5 to 60 nm, it was possible to obtain the effect of the present invention. It is presumed that use of relatively small alumina particles in the range of 5 to 60 nm improves the fluidity of the toner and makes it easier for the alumina particles to migrate from the toner particles to the carrier particles. Thereby, it was possible to stabilize the charge amount fluctuation during high coverage printing.

In addition, the resin covering layer of the carrier particles according to the present invention is formed using an alicyclic (meth) acrylate monomer. It is inferred that the resin according to this coating layer was able to suppress the lowering of the charge amount at high temperature and high humidity because it has lower hygroscopicity than the conventionally used thermosetting straight silicone resin.

In addition, conventional alumina particles have a high Mohs hardness, and there is a problem that burying in toner particles tends to occur because the impact is large when the developer is agitated in the developing machine during low coverage printing. In the resin covering layer of the carrier particle according to the present invention, a cyclic alkyl group unit is present (that is, a bulky portion is present in a part of the molecule). Since the collision between the toner particles and the carrier particles is reduced, the embedding of the alumina articles is suppressed, and it is presumed that the charge amount fluctuation at the time of the low coverage can be suppressed.

Hereinafter, one or more embodiments of the present invention will be described with reference to the drawings. However, the scope of the invention is not limited to the disclosed embodiments.

The two-component developer for developing an electrostatic latent image of the present invention includes an electrostatic latent image developing toner containing toner mother particles having an external additive on the surface of the toner mother particles and carrier particles. Wherein the external additive contains at least alumina particles, the alumina particles are surface-modified with a hydrophobilizing agent, among the hydrophobilizing agent existing on the surface of the alumina particles after the surface modification, a ratio of the hydrophobilizing agent in a state of being liberated from the surface is 20% or less when extraction treatment is performed under a predetermined condition, the alumina particles have a number average primary particle diameter in the range of 5 to 60 nm, and the carrier particles have a resin covering layer, and the resin covering layer is formed with an alicyclic (meth)acrylate monomer. This feature is a technical feature common or corresponding to the following embodiments.

As an embodiment of the present invention, from the viewpoint of more effectively obtaining the effect of the present invention, it is preferable that the total amount of carbon derived from the hydrophobilizing agent present on the surface of the alumina particle after the surface modification s in the range of 0.5 to 10 mass % based on the alumina particles.

As an embodiment of the present invention, from the viewpoint of more effectively obtaining the effect of the present invention, it is preferable that the content of the alumina particles is in the range of 0.1 to 2.0 mass parts with respect to 100 mass parts of the toner particles.

As an embodiment of the present invention, it is preferable that the external additive further contains silica particles having a number average primary particle diameter of 10 to 60 nm. From the viewpoint of imparting chargeability, it is preferable to further include silica particles as an external additive. Inclusion of silica particles having a number average primary particle diameter of in the range of 10 to 60 nm as an external additive improves the fluidity of the toner. Since toner particles and carrier particles may sufficiently be mixed when toner is replenished to a developing machine, a stable charge amount transition is obtained, this is preferable.

As an embodiment of the present invention, it is preferable that the external additive further contains silica particles having a number average primary particle diameter of primary particles of 80 to 150 nm. The inclusion of silica particles having an average particle diameter of primary particles in the range of 80 to 150 nm as an external additive is preferable, because it has the effect of reducing the impact of toner particles and carrier particles when the developer is agitated in the developing machine during low coverage printing.

As an embodiment of the present invention, from the viewpoint of more effectively obtaining the effect of the present invention, it is preferable that the resin covering layer is formed with a polymer obtained by polymerizing the alicyclic (meth)acrylate monomer and the chain (meth) acrylate monomer.

As an embodiment of the present invention, from the viewpoint of more effectively obtaining the effect of the present invention, it is preferable that the resistance of the carrier particles is in the range of $1.0\times10^{9}$ to $1.0\times10^{11}$ Ω·cm.

As an embodiment of the present invention, the volume average particle size of the toner particles is preferably in the range of 3.0 to 6.5 μm. From the viewpoint of ease of manufacture, it is preferable to set the volume average particle diameter of the toner particles to 3.0 μm or more. From the viewpoint of not excessively lowering the charge amount, and making it difficult to cause image failure due to the low charge amount component, the volume average particle diameter of the toner particles is preferably 6.5 μm or less.

As an embodiment of the present invention, from the viewpoint of reducing variations in charge amount due to environmental difference, it is preferable that the binder resin constituting the toner particles contains a vinyl resin.

As an embodiment of the present invention, from the viewpoint of making it difficult to suppress embedding of external additive particles in toner mother particles, it is preferable that the binder resin constituting the toner particles further contains a polyester resin. When bulky molecules having an alicyclic structure in the main chain are contained in the binder resin, there is an effect of softening the mechanical strength of the toner particles. Therefore, it is possible to reduce the collision between the carrier particles and the toner particles, and to suppress the embedding of the external additive particles in the toner mother particles.

The present invention and the constitution elements thereof, as well as configurations and embodiments, will be detailed in the following. In the present description, when two figures are used to indicate a range of value before and after "to", these figures are included in the range as a lowest limit value and an upper limit value.

[Two-Component Developer for Developing an Electrostatic Latent Image]

A two-component developer for developing an electrostatic latent image according to the present invention (hereafter it may be simply called as "two-component developer" or "developer") comprises: a toner for developing an electrostatic latent image containing toner particles containing toner mother particles having an external additive on a surface of the toner mother particles; and carrier particles. Wherein, the external additive contains at least alumina particles, and the alumina particles are subjected to surface modification with a hydrophobilizing agent. Among the hydrophobilizing agent existing on the surface of the alumina particles after the surface modification, the ratio of the hydrophobilizing agent in a state of being liberated from the surface is 20% or less when extraction treatment is performed under a predetermined condition. The number average primary particle diameter of the alumina particles is in the range of 5 to 60 nm. Wherein the carrier particles have a resin covering layer, and the resin covering layer is formed using an alicyclic (meth)acrylate monomer. In the present invention, "(meth)acrylate" means acrylate or methacrylate.

It is possible to obtain a two-component developer by mixing the toner particles according to the present invention and the carrier particles. The mixing apparatus used for mixing is not particularly limited, and examples thereof include a NAUTA MIXER, a DOUBLE CONE MIXER, and a V MIXER. A content (toner concentration) of the toner in the two-component developer is not particularly limited, but from the viewpoint of effectively obtaining the effect of the present invention, the content is preferably in the range of 4.0 to 8.0 mass %.

[Toner for Developing an Electrostatic Latent Image]

In the present invention, "toner" means an aggregate of "toner particles". In addition, the toner particles contain at least toner mother particles, and the toner particles are loner mother particles themselves or those obtained adding at least an external additive to the, toner mother particles.

The production method of the toner according to the present invention is not particularly limited. Any known methods may be used. Examples of the method include: a kneading pulverization method, a suspension polymerization, an emulsion aggregation method, a dissolution suspension method, a polyester extension method, and a dispersion polymerization method. Among these processes, preferred is an emulsion aggregation method in view of the uniformity of the particle size and control of the shape of the toner.

<Toner Mother Particles>

The toner mother particles according to the present invention preferably contain other constituent components such as a colorant, a release agent (wax), and a charge control agent, as necessary in the binder resin.

An external additive containing at least alumina particles is externally added to the toner mother particles according to the present invention.

<External Additive>

The external additive according to the present invention contains at least alumina particles. The alumina particle refers to aluminum oxide represented by $A1_2O_3$, and forms of α type, γ type, σ type, and a mixture thereof are known. Regarding to the shape of the particles, it is known that cubic shape to spherical shape that are produced by the control of the crystalline type.

The alumina particles may be prepared by a known method. As a method for preparing the alumina particles, the BAYER METHOD is common. In order to obtain highly pure and nano-sized alumina, there are cited a hydrolysis method (manufactured by Sumitomo Chemical Co. Ltd.), a gas phase synthesis method (manufactured by CI Kasei Co. Ltd.), a flame hydrolysis method (manufactured by Nippon Aerosil Co. Ltd.), and a underwater spark discharge method (manufactured. by Iwatani Chemical Industry Co. Ltd.).

The alumina particles according to the present invention are subjected to surface modification with a hydrophobilizing agent. Among the hydrophobilizing agent existing on the surface of the alumina particles after the surface modification, the ratio of the hydrophobilizing agent in a state of being liberated from the surface is 20% or less, and more preferably 10% or less when extraction treatment is performed under a predetermined. condition. Thus, it is presumed that by covering the alumina particles with an appropriate amount of the surface modifying agent, alumina particles could have the same degree of resistance as the carrier particles. In addition, when it is less than 20%, the released surface treatment agents are less likely to aggregate and the fluidity is less likely to deteriorate. Since the mixing property between the toner particles and the carrier particles becomes high, the charge amount variation may be suppressed to a small value.

Further, from the viewpoint of more effectively obtaining the effect of the present invention, it is preferable that the total amount of carbon derived from the hydrophobilizing agent existing on the surface of the alumina particles after the surface modification is in the range of 0.5 to 10 mass %.

In the present invention, "the ratio" in the expression of "among the hydrophobilizing agent existing on the surface of the alumina particles after the surface modification, the ratio of the hydrophobilizing agent in a state of being liberated from the surface when extraction treatment is performed under a predetermined condition" is determined by measuring the proportion of carbon released from the surface among the hydrophobilizing agent existing on the surface of the alumina particles when extraction treatment is performed under a predetermined condition to release the hydrophobilizing agent. Further, according to the following measurement method, the total amount of carbon derived from the hydrophobilizing agent present on the surface after surface modification of the alumina particles is also calculated.

(Measuring Method)

(1) By using a SOXHLET EXTRACTOR (made by BUCHI Co.), 0.7 g of the alumina particles in a powder state is put in a cylinder filter of 28 mm diameter and 100 mm length. n-Hexane is used for an extraction solvent in an amount of 30 to 100 mL. Free hydrophobilizing agent released from the alumina particles in a powder state is removed under the condition of extraction time of 60 minutes at a temperature of 68 to 110° C. and rinse time of 30 minutes.

(2) For the alumina particles after the surface modification with the hydrophobilizing agent, the amounts of carbon are respectively measured before and after the extraction operation of (1) above. The quantitative analysis of carbon is determined by a CHN ELEMENT ANALYZER (SUMIGRAPH NC-TR22 manufactured by Sumika Chemical Analysis Center).

(3) The ratio of the hydrophobilizing agent liberated from the surface among the hydrophobilizing agent present on the surface after the surface modification is calculated by the following formula (Free carbon ratio of the hydrophobilizing agent).

$$\text{Free carbon ratio} = \{(C0-C1)/C0\} \times 100$$

C0: total amount of carbon derived from the hydrophobilizing agent present on the alumina particle surface before the extraction operation C1: total amount of carbon derived from the hydrophobilizing agent present on the alumina particle surface after the extraction operation.

For the alumina particles after the surface modification, the above-described. value "C0: total amount of carbon derived from the hydrophobilizing agent present on the alumina particle surface before the extraction operation" is also calculated. Although n-hexane was used as the extraction solvent, it is also possible to use a solvent other than n-hexane. In that case, measurement can be carried out in the same manner as described above by appropriately setting the measurement temperature according to the boiling point of the solvent.

(Hydrophobilizing Agent)

As a hydrophobilizing agent, known coupling agents, silicone oils, aliphatic acids, metal salts of aliphatic acids may be used. It is preferable to use silane compounds and silicone oils.

Examples of the silane compound include chlorosilane, alkoxysilane, silazane, and special silylation agents. More specific examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-(epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Particularly preferred examples of the hydrophobilizing agent used in the present invention include isobutyltrimethoxysilane, and octyltrimethoxysilane.

Specific examples of the silicone oil include cyclic compounds such as organosiloxane oligomers, octamethylcyclotetrasiloxane, decamethylcyclopentasiloxane, tetramethylcyclotetrasiloxane, and tetravinyltetramethylcyclotetrasiloxane; and straight chain or branched chain organosiloxanes. Highly reactive silicone oils having a modified-terminal at least one end may be also used, which is introduced a modified group at one or both ends of the main chain, or one end or both ends of each side chain. Non-limiting examples of the modified group include alkoxy, carboxy, carbinol, modified higher fatty acid, phenol, epoxy, methacrylic, and amino groups. Silicone oils having two or more types of modified groups such as amino and alkoxy modified groups may be also used. Dimethyl silicone oil may be mixed or combined with one or more of these modified silicone oils, optionally further with one or more of other surface modification agents. Examples of the surface modification agent used with these silicone oils include silane coupling agents, titanate coupling agents, aluminate coupling agents, various silicone oils, fatty acids, metal salts of fatty acids, esterified compounds thereof, and rosin acids.

Examples of the above-described surface modification method include a dry process such as a spray drying process involving spray of the silica particles suspended in a gas phase with a surface modification agent or a solution containing a surface modification agent; a wet process involving immersion of the particles in a solution containing a surface-treating agent and then drying; and a mixing process involving mixing of the particles with a treating agent in a mixer.

(Particle Diameter of Alumina Particles)

The number average primary particle diameter of the alumina particles is preferably from 5 to 60 nm, and more preferably from 5 to 40 nm from the viewpoint of ease of production and obtaining the effect of the present invention. Use of relatively small alumina particles in the range of 5 to 60 nm improves the fluidity of the toner and makes it easier for the alumina particles to migrate from the toner particles to the carrier particles. It is presumed that fluctuation in charge amount may be stabilized during high coverage printing.

(Measuring Method: Particle Diameter)

A particle diameter of alumina particles is measured by using a scanning electron microscope (for example, "JSM-7401F" made by JOEL Co. Ltd.). An SEM photograph of the toner enlarged by 30,000 times is taken, the particle diameter (Feret's diameter) of the primary particle of the particle is measured by observing the SEM photograph, and the total value is divided by the number of particles to obtain the average particle diameter. The particle diameter can be measured by selecting a region in which the total number of particles is about 100 to 200 in the SEM image.

(Content of Alumina Particles)

The content of the alumina particles is preferably in the range of 0.1 to 2.0 mass parts with respect to 100 mass parts of the toner particles. From the viewpoint of the effect of the present invention, it is preferably 0.1 mass parts or more. By setting the amount to 2.0 mass parts or less, the probability that the alumina particles receive the impact of the toner particles and the carrier particles when the developer is agitated in the developing machine during low coverage printing can be suppressed to be low. As a result, it is possible to make it difficult for the alumina particles to be embedded in the toner mother particles.

(External Additives Other than Alumina Particles)

As external additives according to the present invention, it is also preferable to further include known external additives in addition to alumina particles. Examples of other known External additive are inorganic oxide particles such as silica particles and titanium oxide particles; inorganic stearate particles such as aluminum stearate and zinc stearate particles; and inorganic titanate nanoparticles such as strontium titanate and zinc titanate particles. These inorganic particles may be subjected to a gloss and hydrophobilizing treatment with a silane coupling agent, a titanium coupling agent, higher fatty acid, or silicone oil to improve the heat-resistant storage characteristics and the environmental stability of the toner.

As an external additive other than the alumina particles, it is preferable to use silica particles from the viewpoint of imparting charging property. It is also preferable to contain silica particles having a number average primary particle diameter in the range of 10 to 60 nm. This makes it possible to improve the fluidity of the toner and sufficiently mix the toner particles and the carrier particles when the toner is replenished to the developing machine. As a result, it is possible to obtain a stable charge amount transition. In addition to silica particles having a number average primary particle diameter in the range of 10 to 60 nm, it is further preferable to contain silica particles having a number average primary particle diameter in the range of 80 to 150 nm. This makes it possible to reduce the impact of toner particles and carrier particles when the developer is agitated in the developing machine during low coverage printing.

Organic particles may be used as other external additives. The organic nanoparticles may be spherical organic particles having a number average primary particle diameter of about 10 to 2,000 nm, for example. Specifically, organic particles composed of a homopolymer of styrene or methyl methacrylate or a copolymer thereof may be used.

Lubricants may be used as external additives. The lubricant is used to further improve the cleaning characteristics and transfer characteristics of the toner. Specific examples of the lubricant are metal salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; and salts of ricinoleic acid with zinc and calcium.

<Amorphous Resin>

As the hinder resin constituting the toner mother particles, a known amorphous resin may be used. Specific examples thereof include vinyl resins, urethane resins, urea resins, and polyester resins. Among these resins, preferred are vinyl resins because the fluctuation clue to environmental difference is small. Any vinyl resin prepared through polymerization of a vinyl compound may be used. Examples thereof include (meth)acrylate ester resins, styrene-(meth)acrylate ester resins, and ethylene-vinyl acetate resins. These vinyl resins may be used alone or in combination. Among these vinyl resins, preferred are styrene-(meth)acrylate ester resins in consideration of the plasticity of the toner during thermal fixing. Hereinafter, a styrene-(meth)acrylic ester resin (hereinafter also referred to as "styrene-(meth) acrylic resin") as an amorphous resin will be described.

The styrene-(meth)acrylic resin is prepared through addition polymerization of at least a styrene monomer and a (meth)acrylate ester monomer. In this specification, the styrene monomer indicates styrene represented by the formula $CH_2{=}CH{-}C_6H_5$, and also includes monomers having a known side chain or functional group in a styrene structure. In this specification, the (meth)acrylate ester monomer indicates an acrylate or methacrylate ester compound represented by $CH_2{=}CHCOOR$ (where R is an alkyl group), and also includes ester compounds having a known side chain or functional group in the structure, such as acrylate ester derivatives and methacrylate ester derivatives. In this specification, the term "(meth)acrylate ester monomer" collectively indicates "acrylate ester monomer" and "methacrylate ester monomer".

Examples of the styrene monomer and the (meth)acrylate ester monomer usable in formation of the styrene-(meth) acrylic resin are listed below.

Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination.

Specific examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate ester monomers, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. These (meth)acrylate ester monomers may be used alone or in combination.

The content of the structural unit derived from the styrene monomer in the styrene-(meth)acrylic resin is preferably in the range of 40 to 90 mass % relative to the total amount of the resin. The content of the structural unit derived from the (meth)acrylate ester monomer in the resin is preferably 10 to 60 mass % relative to the total amount of the resin. Besides the styrene monomer and the (meth)acrylate ester monomer, the styrene-(meth)acrylic resin may further contain the following monomer compound. Examples of the monomer compound include compounds having a carboxy group, such as acrylic acid, methacrylic acid, maleic acid, itaconic acid, cinnamic acid, fumaric acid, monoalkyl maleate ester, and monoalkyl itaconate ester; and compounds having a hydroxy group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth)acrylate. These monomer compounds may be used alone or in combination.

The content of the structural unit derived from the monomer compound in the styrene-(meth)acrylic resin is preferably in the range of 0.5 to 20 mass % relative to the total amount of the resin. The styrene-(meth)acrylic resin preferably has a weight average molecular weight (Mw) of 10,000 to 100,000.

The styrene-(meth)acrylic resin may be prepared by any process. Examples thereof include known polymerization processes, such as bulk polymerization, solution polymerization, emulsion polymerization, mini-emulsion polymerization, and dispersion polymerization, in the presence of any polymerization initiator, such as peroxide, persulfides, persulfates, or azo compounds usually used in polymerization of the monomers. A chain transfer agent usually used may also be used to control the molecular weight of the resin. Any chain transfer agent may be used. Examples thereof include alkyl mercaptans, such as n-octyl mercaptan, and mercapto aliphatic acid esters.

The glass transition temperature (Tg) of the resin is not particularly limited, but from the viewpoint of reliably obtaining fixability such as low temperature fixing property and heat resistance such as heat resistant storage property and blocking resistance, it is preferable to be 25 to 60° C.

From the viewpoint of softening the mechanical strength of the toner and suppressing embedding of the external additive, it is preferable that the binder resin further contains a polyester resin in addition to the above-mentioned vinyl resin. The polyester resin according to the present invention is produced by a polycondensation reaction in the presence of an appropriate catalyst using a polycarboxylic acid monomer (derivative) and a polyhydric alcohol monomer (derivative) as raw materials.

As the polyvalent carboxylic acid monomer derivative, an alkyl ester of a polyvalent carboxylic acid monomer, acid anhydrides and acid chlorides may be used, and as the polyhydric alcohol monomer derivatives, ester compounds of polyhydric alcohol monomers and hydroxycarboxylic acids may be used. Examples of the polyvalent carboxylic acid monomer are dicarboxylic acids such as oxalic acid, succinic acid, maleic acid, adipic acid, β-methyladipic acid, azelaic acid, sebacic acid, nonanedicarboxylic acid, decanedicarboxylic acid, undecane dicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenedigdycolic acid, p-phenylenediglycolic acid, o-phenylenediglycolic acid, diphenylacenc acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid, and dodecenylsuccinic acid; and tri or higher valent carboxylic acids such as trimellitic acid, pyromellitic acid, naphthalene tricarboxylic acid, naphthalene tetracarboxylic acid, pyrene tricarboxylic acid, and pyrene tetracarboxylic acid. As the polyvalent carboxylic acid monomer, it is preferable to use unsaturated aliphatic dicarboxylic acids such as fumaric acid, maleic acid and mesaconic acid. In the present invention, an anhydride of a dicarboxylic acid such as maleic anhydride may also be used.

Examples of the polyhydric alcohol monomer are divalent alcohols such as ethylene glycol, propylene glycol, butanediol, diethylene glycol, hexanediol, cyclohexanediol, octanediol, decanediol, dodecanediol, ethylene oxide adduct of bisphenol A, and propylene oxide adduct of bisphenol A; tri or higher valent polyols such as Glycerin, pentaerythritol, hexamethylol melamine, hexamethyl melamine, tetramethylol benzoguanamine, and tetraethylol benzoguanamine.

From the viewpoint of low-temperature fixability, the binder resin according to the present invention preferably further contains a crystalline resin in addition to the amorphous resin.

<Colorant>

Any colorant, such as carbon black, magnetic substances, dyes, and pigments, may be used. Examples of usable carbon black include channel black, furnace black, acetylene black, thermal black, and lamp black. Examples of the magnetic substances include ferromagnetic metals, such as iron, nickel, and cobalt; alloys containing these metals; and compounds of ferromagnetic metals, such as ferrite and magnetite.

Examples of the dyes include C.I. SOLVENT REDS 1, 49, 52, 58, 63, 111, and 122; C.I. SOLVENT YELLOWS 19, 44, 77, 79, 81, 82, 93, 98, 103, 104, 112, and 162; C.I. SOLVENT BLUES 25, 36, 60, 70, 93, and 95; and mixtures thereof.

Examples of the pigments include C.I. PIGMENT REDS 5, 48:1, 48:3, 53:1, 57:1, 81:4, 122, 139, 144, 149, 166, 177, 178, and 222; C.I. PIGMENT ORANGES 31 and 43; C.I. PIGMENT YELLOWS 14, 17, 74, 93, 94, 138, 155, 180, and 185; C.I. PIGMENT GREEN 7; C.I. PIGMENT BLUES 15:3, 15:4, and 60; and mixtures thereof.

<Releasing Agent>

The releasing agent may be a variety of known waxes. Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide. The content of the releasing agent is preferably in the range of 0.1 to 30 mass parts, more preferably 1 to 10 mass parts relative to 100 mass parts of binder resin. These releasing agents may be used alone or in combination of two or more kinds. The preferred melting point of the releasing agent is in the range of 50 to 95° C. in view of the low-temperature fixing characteristics and releasing characteristics of the electrophotographic toner.

<Charge Controlling Agent>

A variety of known charge controlling agent particles that can be dispersed in an aqueous medium may be used. Specific examples thereof include: nigrosine dyes, metal salts of naphthenic acid or higher fatty acids, alkoxylated amines, quaternary ammonium salts, azo metal complexes, and salicylic acid metal salts or metal complexes thereof.

<Volume-Based Average Particle Diameter of Toner Particles>

It is preferable that the toner particles have a volume average particle diameter of 3.0 to 6.5 μm. From the viewpoint of ease of manufacture, it is preferable to set the volume average particle diameter of the toner particles to 3.0 μm or more. From the viewpoint of reducing the possibility of occurrence of an image defect clue to a low charge amount component without making the charge amount excessively low, the volume average particle diameter of the toner particles is preferably 6.5 μm or less.

(Measuring Method: Toner Particle Diameter)

In the present invention, "a volume average diameter" of toner particles is a volume-based median diameter ($D_{50}$). It may be measured and calculated by using measuring equipment composed of "MULTISIZER 3" (Beckman Coulter Inc.) and a computer system installed with a data processing software.

Specifically, a predetermined amount (0.02 g) of a measuring sample (toner particles) is added to a predetermined amount (20 mL) of surfactant solution (for dispersing the toner particles, e.g. a surfactant solution prepared by eluting a neutral detergent containing a surfactant component with purified water by 10 times) and is allowed to be uniform, and then the solution is subjected to ultrasonic dispersion.

The toner particle dispersion liquid thus prepared is added to "ISOTON II" (Beckman Coulter Inc.) in a beaker placed in sample stand by a pipet until the concentration displayed on the measuring equipment reaches 5 to 10%. The measuring particle count of the measuring equipment is set to be 25,000.

The aperture size of the measuring equipment is set to be 100 μm. The measuring range, which is from 1 to 30 μm, is divided into 256 sections to calculate the respective frequencies. The particle diameter where the accumulated volume counted from the largest size reaches 50% is determined as the volume-based median diameter ($D_{50}$).

The volume average particle diameter of the toner particles may be controlled by changing the concentration of the aggregating agent, the added amount of organic solvent, or fusing time used in the production.

<Average Circularity of Toner Particles>

It is preferable that the toner particles in the toner of the present invention have an average circularity of 0.995 or less, more preferably 0.985 or less, and still more preferably in the range of 0.93 to 0.97. When the average circularity is within this range, the toner particles are more easily charged.

The average circularity of the toner particles is measured with a flow-type particle image analyzer "FPIA-3000" (made by Sysmex Corporation), for example. Specifically, it may be measured by the following method.

(Measuring Method)

Specifically, a measuring sample (toner particles) is wetted in an aqueous surfactant solution, and is ultrasonically dispersed for one minute. After making the dispersion, the average circularity is measured with the analyzer "FPIA-3000" in a high power field (HPF) mode at an appropriate density (the number of particles to be detected at an HPF: 3000 to 10000 particles). This range will provide reproducibility in the measurement. The circularity is calculated from the following expression:

Circularity of toner particle=(Perimeter of a circle having a projected area identical to that of the projected image of a particle)/(Perimeter of the projected image of the particle)

The average circularity indicates the arithmetic average value obtained by dividing the sum of circularities of particles by the number of particles. The average circularity of the toner particles may be adjusted by controlling the temperature or time of the ripening treatment in the above-described production method.

<Production Method of Toner for Developing an Electrostatic Latent Image>

The production method of the toner according to the present invention is not particularly limited. Any known methods may be used. Examples of the method include: a kneading pulverization method, a suspension polymerization, an emulsion aggregation method, a dissolution suspension method, a polyester extension method, and a dispersion polymerization method. Among these processes, preferred is an emulsion aggregation method in view of the uniformity of the particle size and control of the shape of the toner.

(Emulsion Aggregation Method)

In the emulsion aggregation method, toner particles are prepared as follows. A dispersion liquid of particles of a binder resin dispersed in a surfactant containing a dispersion stabilizer (hereinafter, also referred to as "binder resin particles") is mixed with a dispersion liquid of particles of a colorant (hereinafter, also referred to as "colorant particles") when necessary, and these particles are aggregated until the toner particles grow to a desired diameter. The binder resin particles are further fused to control the shapes of the toner particles. In this specification, the binder resin particles may optionally contain a mold release agent and a charge controlling agent.

As a preferable production method of the toner of the present invention, an example in which toner particles having a core-shell structure is obtained using an emulsion aggregation method is described below. Hereinafter, toner particles having a core-shell structure will be described, but the toner particles according to the present invention may have no core-shell structure.

(1) a step of preparing a dispersion liquid of colorant particles dispersed in an aqueous medium, (2) a step of dispersing binder resin particles containing internal additives when necessary in aqueous media to prepare a dispersion liquid of resin particles (a dispersion liquid of resin particles for a core and a dispersion liquid of resin particles for a shell layer), (3) a step of mixing the dispersion liquid of colorant particles with the dispersion liquid of resin particles for a core to yield a resin particle dispersion liquid for aggregation, and aggregating and fusing colorant particles and binder resin particles in the presence of an aggregating agent to form aggregated particles as core material particles (aggregation and fusion step), (4) a step of adding the dispersion liquid of resin particles for a shell layer to the dispersion liquid of resin particles for a core, and aggregating and fusing the particles for a shell layer onto the surfaces of the core material particles to form toner mother particles having a core-shell structure (aggregation and fusion step), (5) a step of filtering the toner mother particles from the dispersion liquid of the toner mother particles (toner mother particles dispersion liquid) to remove the surfactant (washing step), (6) a step of drying the toner mother particles (drying step), and (7) a step of adding an external additive to the toner mother particles (external additive treating step).

The toner particles having a core-shell structure may be prepared as follows. First, binder resin particles for core material particles and colorant particles are aggregated and fused into core material particles. Then, binder resin particles for a shell layer are added to the dispersion liquid of core material particles, and the binder resin particles for a shell layer are aggregated and fused onto the surfaces of the core material particles to form a shell layer on the surfaces of the core material particles. The toner particles having a mono layer formed without adding the dispersion liquid of resin particles for a shell layer in the step (4) may be produced in the same way.

<External Additive Treatment>

The external additive treating step (7) will be described. An external additive may be mixed with the toner mother particles using a mechanical mixer. The mechanical mixer used may be a Henschel mixer, a Nauta Mixer, or a turbular mixer. Among these mixers, a Henschel mixer, which can impart shear force to the particles, may be used to mix the materials for a longer time or with a stirring blade at a higher circumferential speed of rotation. When several kinds of external additives are used, all of the external additives may be mixed with the toner particles in one batch, or several aliquots of the external additives may be mixed with the toner particles.

In the mixing of the external additive, the degree of crush or adhesive strength of the external additive may be controlled with the mechanical mixer through control of the mixing strength or circumferential speed of the stirring blade, the mixing time, or the mixing temperature.

[Carrier Particles]

The carrier particle according to the present invention has a resin covering layer, and the resin covering layer is formed using an alicyclic (meth)acrylate monomer.

From the viewpoint of manifesting the effect of the present invention, it is preferable that the carrier particles according to the present invention have a resistance in the range of $1.0\times10^{9}$ to $1.0\times10^{11}$ Ω.cm. The resistance of the carrier particles in the present invention is the resistance that is dynamically measured under the developing condition by the magnetic brush. An aluminum electrode drum having the same size as the photosensitive drum is replaced with the photosensitive drum. Then, the carrier particles are supplied onto the developing sleeve to form a magnetic brush. The formed magnetic brush is rubbed against the electrode drum. A voltage (500 V) is applied between the developing sleeve and the electrode drum to measure the current that flows therebetween. The resistance of the carrier particles is obtained by the following expression.

$$DVR(\Omega\cdot cm)=(V/I)\times(N\times L/Dsd)$$

In the aforesaid expression, the symbols indicate the following.

DVR: Resistance of carrier particles (Ω.cm)

V: Voltage between the developing sleeve and the electrode drum (V)

I: Measured electric current (A)

N: Developing nip width (cm)

L: Developing sleeve length (cm)

Dsd: Distance between the developing sleeve and the electrode drum (cm)

In the present invention, the measurement was done with the conditions of: V=500V, N=1 cm, L=6 cm, and Dsd=0.6 mm.

It is preferable that the carrier particles have a volume-based median diameter in the range of 10 to 100 μm, more preferably 20 to 80 μm. The volume-based median diameter of the carrier particles may be measured by a laser diffraction particle size analyzer "HELOS" (manufactured by SYMPAIEC GmbH) including a wet dispersion device.

<Core Material Particles>

The carrier particles according to the present invention contain a core material particle and a resin covering layer that covers the surface of the core material particle.

Examples of the core material particles (magnetic particles) used in the present invention include: iron powders, magnetite, various ferrite particles, and the material in which these substances are dispersed in a resin. Among them, it is preferable to use magnetite or various ferrite particles. Preferable ferrite are: ferrite containing metals such as copper, zinc, nickel, and manganese; and light metal ferrite containing an alkali metal and/or an alkaline earth metal. In addition, it is preferable that strontium (Sr) is contained as the core material particle. By containing strontium, irregularities on the surface of the core material particles can be increased, and even when the resin is coated, the surface is more likely to be exposed and the resistance of the carrier particles can be easily adjusted.

(Production Method of Core Material Particles)

After weighing an appropriate amount of the raw material, it is pulverized and mixed preferably for 0.5 hour or more, more preferably for 1 to 20 hours with a wet media mill, a ball mill, or a vibration mill. The pulverized material thus obtained was pelletized using a pressure molding machine. Thereafter, it is preferably calcined at a temperature of 700 to 1200° C., preferably for 0.5 to 5 hours.

Here, instead of using a compression molding machine, after grinding, water may be added to make a slurry and granulated by using a spray dryer. After preliminary firing the mixture is further pulverized with a ball mill or a vibration mill. Subsequently, water and, if necessary, a dispersant, a binder such as polyvinyl alcohol (PVA) are added to the mixture to adjust the viscosity, and it is granulated. Then, main firing is performed. The main firing temperature is preferably 1000 to 1500° C., and the main firing time is preferably 1 to 24 hours. When pulverizing is done after the preliminary firing, water may be added and pulverized with a wet ball mill or a wet vibration mill.

The pulverizer such as the above-mentioned ball mill and vibration mill is not particularly limited, but in order to effectively and uniformly disperse the raw materials, it is preferable to use fine beads having a particle diameter of 1 cm or less in the medium to be used. Further, by adjusting the diameter, composition, and pulverization time of the beads to be used, the degree of pulverization can be controlled.

The fired product thus obtained is pulverized and classified. As a classification method, the particle diameter is adjusted to a desired particle size by using known wind classification method, mesh filtration method, or precipitation method. Thereafter, if necessary, resistance adjustment can be carried out by subjecting the surface to low temperature heating and applying an oxide film treatment. The oxide coating treatment may be performed at a temperature of, for example, 300 to 700° C. by using a general rotary electric furnace, or a batch type electric furnace. The thickness of the oxide film formed by this treatment is preferably 0.1 nm to 5 μm. When the thickness of the oxide film is within the above range, the effect of the oxide film layer is obtained, and it is preferable since the desired characteristic may be easily obtained because the oxide film thickness does not become too high. If necessary, reduction may be performed before the oxide coating treatment. Also, after classification, low magnetic products may be further separated by magnetic separation.

<Resin Covering Layer>

The resin covering layer according to the present invention is a layer formed with an alicyclic (meth)acrylate monomer. By including a resin formed from an alicyclic (meth)acrylate monomer having low hygroscopicity, it is possible to suppress the charge amount fluctuation due to the environmental difference arid suppress the embedding of the alumina particles due to the collision between the toner particles and the carrier particles.

The alicyclic (meth)acrylate monomer is preferably a compound containing a cycloalkyl group having 5 to 8 carbon atoms carbon atoms from the viewpoints of mechanical strength, environmental stability of charge amount (small environmental difference in charge amount), the ease of polymerization and the availability. It is preferable that the alicyclic (meth)acrylate monomer is at least one selected from the group consisting of cyclopentyl (meth)acrylate, cyclohexyl (meth)acrylate, cycloheptyl (meth)acrylate and cyclooctyl (meth)acrylate. Among these, cyclohexyl (meth) acrylate is preferably contained from the viewpoint of mechanical strength and environmental stability of the charge amount. Further, for the resin covering layer according to the present invention, a copolymer of an alicyclic (meth)acrylate compound and a chain type methyl methacrylate is more preferable. From the viewpoint of further increasing the film strength, it is preferable to use methyl methacrylate as the chain type (meth)acrylate monomer. When a copolymer is used, it is preferable that the alicyclic (meth) acrylate monomer is contained in the range of 25 to 75 mass % as the composition ratio. When the content is 25% mass % or more, the effect of the present invention may be sufficiently exhibited, when the content is 75 mass % or less, the film strength is strengthen, and the fluctuation range of the charge amount may be reduced even when it is used for a long time.

(Covering Method)

Specific examples of the method for producing the resin covering layer include a wet coating method and a dry coating method. Although each method will be described below, a dry coating method is a particularly desirable method for applying to the present invention.

As the wet coating method, a fluidized bed spray coating method, an immersion coating method, and a polymerization method may be mentioned.

The fluidized bed type spray coating method is a method in which a coating solution prepared by dissolving a coating resin in a solvent is sprayed onto the surface of core material particles using a fluidized bed and then dried to prepare a covering layer.

The immersion type coating method is a method in which core material particles are immersed in a coating solution prepared by dissolving a coating resin in a solvent and coated, followed by drying to prepare a covering layer.

The polymerization method is a method of preparing a covering layer by coating core material particles in a coating solution prepared by dissolving a reactive compound in a solvent, applying a coating treatment, and then applying heat to carry out a polymerization reaction.

Next, the dry coating method will be described. In the dry coating method, for example, resin particles are deposited on the surface of the particles to be coated and then mechanical impact force is applied to melt or soften the resin particles adhered to the surface of the particles to be coated to fix them. Thereby a covering layer is formed. The core material particles, the resin, and the low resistance fine particles are agitated at high speed using a high speed stirring mixer capable of applying a mechanical impact force under nonheating or heating condition. Then, by imparting an impulsive force repeatedly to the mixture, and by dissolving or softening it on the surface of the core material particle, fixed carrier particles are produced. As the coating condition, when heating, the temperature is preferably 80 to 130° C. The wind speed which generates the impact force is preferably 10 m/s or more during heating, and 5 m/s or less in order to suppress the aggregation of the carrier particles at the time of cooling. The time for imparting the impact force is preferably 20 to 60 minutes.

Next, in the step of coating the resin or in the step after coating, a method of stripping the resin at the convex portions of the core material particles by applying stress to the carrier particles and exposing the core material particles will be described. In the resin coating process by the dry coating method, peeling of the resin may be caused by lowering the heating temperature to 60° C. or less while making the wind speed during cooling to be high shear. In addition, as a process after coating, it is possible to use any apparatus which is capable of performing forced stirring. For example, stirring and mixing with a turbuler mixer, a ball mill, or a vibration mill may be mentioned.

In addition, as a method of exposing the core material by moving the resin on the surface of the convex portion toward the concave side by applying heat and impact to the coating resin, it is effective to take a long time to impart the impact force. Specifically, it is preferable to set it to 1.5 hour or more.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, the present invention will be specifically described with reference to examples, but the present invention is not limited thereto.

[Production of Alumina Particles]

(Production of Alumina Particles 1a)

The alumina particles produced by a known method can be used. Hereinafter, the present invention will be specifically described with reference to examples, but the present invention is not limited thereto. As an example of a method for producing alumina particles, the content of Japanese Patent Application Publication No. 2012-224542 was referred to, and the known burner device described in Example 1 of European Patent No. 0585544 was adopted. Thereby alumina particles la were prepared.

320 kg/h of aluminum trichloride ($AlCl_3$) was evaporated in an evaporator at about 200° C., and the chloride vapor was passed by nitrogen into the mixing chamber of the burner. Here, the gas stream was mixed with 100 $Nm^3/h$ of hydrogen and 450 $Nm^3/h$ of air and fed to the flame via a central tube (7 mm diameter). As a result, the burner temperature was 230° C. and the discharge speed of the tube was about 35.8 m/s. 0.05 $Nm^3/h$ of hydrogen was supplied as a jacket type gas via the outer tube. The gas was burned in the reaction chamber and was cooled to about 110° C. in the downstream aggregation zone. In that place, aggregation of primary particles of alumina takes place. Adherent chloride was removed from the simultaneously produced hydrochloric acid-containing gas by separating the resulting aluminum oxide particles in a filter or cyclone and treating the powder with moist air at about 500 to 700° C. Thus, alumina particles [1a] having the particle size indicated in the following table were obtained. The particle size of the alumina particles may be changed depending on the reaction conditions, such as the flame temperature, the content of hydrogen or oxygen, the quality of aluminum trichloride, the residence time in the flame or the length of the aggregation zone.

(Surface Modification)

The obtained alumina particles 1a were placed in a reaction vessel. While stirring the powder with rotating blades in a nitrogen atmosphere, a substance obtained by diluting 20 g of isobutyltsimethoxysilane as a hydrophobilizing agent with 60 g of hexane was added to 100 g of the alumina powder in the reaction vessel. After heating and stirring the mixture at 200° C. for 120 minutes, the mixture was cooled with cooling water to obtain alumina particles 1.

The total amount of carbon derived from the hydrophobilizing agent present on the surface of the alumina particles [1] after surface modification was 2.1 mass % based on the alumina particles after surface modification. In addition, among the hydrophobilizing agents present on the surface after the surface modification, the ratio of the hydrophobilization agent in a state of being liberated from the surface when the extraction treatment was performed under predetermined conditions described later was 0%.

The above-described values were measured as follows.

(Measuring Method)

(1) By using a SOXHLET EXTRACTOR (made by BUCHI Co.), 0.7 g of the alumina particles in a powder state was put in a cylinder filter of 28 mm diameter and 100 mm length. n-Hexane was used for an extraction solvent in an amount of 30 to 100 mL.

Free hydrophobilizing agent released from the alumina particles in a powder state was removed under the condition of extraction time of 60 minutes at a temperature of 68 to 110° C. and rinse time of 30 minutes.

(2) For the alumina particles after the surface modification with the hydrophobilizing agent, the amounts of carbon were respectively measured before and after the extraction operation of (1) above. The quantitative analysis of carbon was determined by a CHN ELEMENT ANALYZER (SUMIGRAPH NC-TR22 manufactured by Sumika Chemical Analysis Center).

(3) The ratio of the hydrophobilizing agent liberated from. the surface among the hydrophobilizing agent present on the surface after the surface modification was calculated by the following formula (Free carbon ratio of the hvdrophobilizing agent).

$$\text{Free carbon ratio} = \{(C0-C1)/C0\} \times 100$$

C0: total amount of carbon derived from the hydrophobilizing agent present on the alumina particle surface before the extraction operation C1: total amount or carbon derived from the hydrophobilizing agent present on the alumina particle surface after the extraction operation.

For the alumina particles after the surface modification, the above-described value "C0: total amount of carbon derived from the hydrophobilizing agent present on the alumina particle surface before the extraction operation" was also calculated, (Production of Alumina Particles 2 to 14)

In the method of preparing the alumina particles 1, various conditions such as the above-mentioned reaction conditions, residence time in the flame, and length of the aggregation zone were adjusted, and further the hydrophobilizing agent for the surface modification was changed to those described in Table I. Thus, alumina particles 2 to 14 indicated in Table I were produced.

TABLE I

| Alumina particle No. | Number average primary particle diameter (nm) | Hydrophobilizing agent | *1 (mass %) | *2 (%) |
|---|---|---|---|---|
| 1 | 20 | Isobutyltrimethoxysilane | 2.1 | 0 |
| 2 | 5 | Isobutyltrimethoxysilane | 3.3 | 0 |
| 3 | 10 | Isobutyltrimethoxysilane | 4.2 | 5 |
| 4 | 40 | Isobutyltrimethoxysilane | 2.5 | 0 |
| 5 | 60 | Isobutyltrimethoxysilane | 4.2 | 4 |
| 6 | 20 | Isobutyltrimethoxysilane | 0.3 | 0 |
| 7 | 20 | Isobutyltrimethoxysilane | 10.2 | 20 |
| 8 | 20 | Isobutyltrimethoxysilane | 4.4 | 9 |
| 9 | 20 | Isobutyltrimethoxysilane | 6.4 | 15 |
| 10 | 10 | Octyltrimethoxysilane | 5.5 | 8 |
| 11 | 20 | Polydimethylsiloxane | 0.5 | 0 |
| 12 | 70 | Isobutyltrimethoxysilane | 6.2 | 3 |
| 13 | 20 | Isobutyltrimethoxysilane | 8.8 | 22 |
| 14 | 20 | Hexamethyldisilazane | 2.0 | 20 |

*1: A ratio of the total amount of carbon derived from the hydrophobilizing agent present on the alumina particle surface after the surface modification with respect to the total amount of the alumina particles after the surface modification

*2: A ratio of the hydrophobilizing agent in a state of being liberated from the surface when extraction treatment is performed under a predetermined condition among the hydrophobilizing agent existing on the surface of the alumina particles after the surface modification

[Production of Toner Mother Particles]

<Preparation of Dispersion Liquid of Styrene-Acryl (StAc) Resin Particles>

(First Stage Polymerization)

Into a reaction vessel equipped with a stirrer, a temperature sensor, a cooling tube, and a nitrogen introducing device, a surfactant aqueous solution containing 4 mass parts of anionic surfactant containing sodium dodecyl sulfate ($C_{10}H_{21}(OCH_2CH_2)_2SO_3Na$) and 3,040 mass parts of ion-exchanged water were charged. Further, a polymerization initiator solution containing 10 mass parts of potassium persulfate (KPS) dissolved in 400 mass parts of ion-exchanged water was added thereto, and the liquid temperature was raised to 75° C.

Subsequently, to this solution was dropwise added a polymerizable monomer solution containing 532 mass parts of styrene, 200 mass parts of n-butyl acrylate, 68 mass parts of methacrylic acid, and 16.4 mass parts of n-octyl mercaptan over 1 hour. After addition, the reaction system was heated and stirred at 75° C. for 2 hours to carry out the polymerization (first stage polymerization). Thus, a dispersion liquid of styrene-acryl resin particles was prepared. A weight average molecular weight (Mw) of the styrene-acryl resin particles in the dispersion liquid was 16,500.

A weight average molecular weight (Mw) of the resin was determined from the molecular weight distribution measured by gel permeation chromatography (GPC: Gel Permeation chromatography). Specifically, the measurement sample was added to tetrahydrofuran (THF) to a concentration of 1 mg / mL:, dispersed for 5 minutes using an ultrasonic disperser at room temperature, and then treated with a membrane filter with a pore size of 0.2 μm. Thus a sample solution was prepared. A measuring device "HLC-8120 GPC" (TOSOH Corp.) and a column set "TSK GUARD COLUMN +3×TSK GEL SUPER HZM-M" (TOSOH Corp.) were used. The column temperature was held at 40° C., and tetrahydrofuran (THF) was supplied at a flow rate of 0.2 mL/min as a carrier solvent. An aliquot (10 μL) of the sample solution was injected into the GPC device along with the carrier solvent and was detected by means of a refractive index (RI) detector. The molecular weight distribution of the sample was calculated by using a calibration curve, which was determined by using standard polystyrene particles. The calibration curve was obtained by using 10 kinds of monodispersed polystyrene standard particles (manufactured by Pressure Chemical Co., Ltd.). The monodispersed polystyrene standard particles each have molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$.

(Second Stage Polymerization)

Into a reaction vessel equipped with a stirrer was added a polymerizable monomer solution containing 101.1 mass parts of styrene, 62.2 mass parts of n-butyl acrylate, 12.3 mass parts of methacrylic acid, and 1.75 mass parts of n-octyl mercaptan. Further, 93.8 mass parts of paraffin wax HNP-57 (manufactured by Nippon Seiro CO. Ltd.) as a releasing agent was added, and the inner temperature of the reaction vessel was heated to 90° C. to dissolve the mixture and prepared a monomer solution.

In a separate vessel, a surfactant aqueous solution prepared by dissolving 3 mass parts of the anionic surfactant used in the first stage polymerization in L560 mass parts of ion-exchanged water was charged, and the mixture was heated to an internal temperature of 98° C. To this aqueous surfactant solution, 32.8 mass parts (in terms of solid content) of the dispersion liquid of styrene-acrylic resin particles obtained by the first stage polymerization was added and the monomer solution containing paraffin wax was further added. The reaction system was mixed and dispersed for 8 hours by using a mechanical disperser with a circulation route "CLEARMIX" (manufactured by M Technique Co., Ltd.) so that a dispersion liquid containing emulsion particles (oil particles) having a particle size of 340 nm was prepared.

To this dispersion, a polymerization initiator solution containing 6 mass parts of potassium persulfate dissolved in 200 mass parts of ion-exchanged water was added. Polymerization (second stage polymerization) was carried out by heating and stirring, the system at 98° C. for 12 hours to prepare a dispersion liquid of styrene-acrylic resin particles. A weight average molecular weight (Mw) of the styrene-acryl resin particles in the dispersion liquid was 23,000.

(Third Stage Polymerization)

A polymerization initiator solution prepared by dissolving 5.45 mass parts Of potassium personate 220 mass parts of ion-exchanged water was added to the dispersion liquid of styrene-acrylic resin particles obtained in the second stage polymerization. To this dispersion, a polymerizable monomer solution containing 293.8 mass parts of styrene, 154.1 mass parts of n-butyl acrylate and 7.08 mass parts of n-octyl mercaptan was dropwise added at a temperature of 80° C. over 1 hour. After completion of the dropwise addition, polymerization was carried out by heating and stirring for 2 hours (third stage polymerization) and then cooled to 28° C. to obtain a dispersion liquid of styrene-acrylic resin particles. A weight average molecular weight (Mw) of the styrene-acryl resin particles in the dispersion liquid was 26,800.

[Dispersion liquid of amorphous polyester resin particles]

Into a reaction. vessel equipped with a stirring device, a nitogen inlet tube, a temperature sensor and a rectifying column were placed the following: 139.5 mass parts of terephthalic acid and 15.5 mass parts of isophthalic acid as a polyvalent carboxylic acid monomer; 290.4 mass parts 2-bis (4- hydroxyphenyl) propane propylene oxide 2 mol adduct (molecular weight =460) and 60.2 mass parts of 2-bis (4 hydroxyphenyl) propane ethylene oxide 2 mol adduct (molecular weight 404 as a polyhydric alcohol monomer. The temperature of the reaction system was increased to 190° C. over 1 hour, and after confirming that the inside of the reaction system was uniformly stirred, 3.21 mass parts of tin octylate was introduced as a catalyst. While distilling off the produced water, the temperature of the reaction system was raised from the same temperature to 240° C. over 6 hours, and the dehydrating condensation reaction was continued for 6 hours while maintaining the temperature at 240° C. to obtain an amorphous polyester resin. The amorphous polyester resin thus obtained had a peak molecular weight (Mp) of 12,000 and a weight average molecular weight (Mw) of 15,000. A dispersion liquid of amorphous polyester resin particles having a solid content of 20 mass % was prepared by performing the same operation as in the preparation of the dispersion liquid of crystalline polyester resin particles to the obtained amorphous polyester resin. A volume-based median diameter ($D_{50}$) of the amorphous polyester resin particles in the dispersion liquid was measured with a particle size distribution measuring instrument "NANOTRACK WAVE" (made by MicrotracBEL, Co. Ltd.). It was found to be 216 nm.

[Dispersion Liquid of Colorant Particles]

90 mass parts of sodium dodecyl sulfate were dissolved with stirring in 1,600 mass parts of ion-exchanged water. While stirring this solution, 420 mass parts of carbon black "REGAL 330R" (made by Cabot Corporations) were gradually added to the solution. Then, the dispersion liquid was dispersed with a stirrer "CLEAMIX" (made by M Technique Co., Ltd.) to prepare a dispersion liquid of colorant particles.

A volume-based median diameter ($D_{50}$) of the colorant particles in the colorant particle dispersion liquid was measured with a particle size distribution measuring instrument "NANOTRACK WAVE" (made by MicrotracBEL, Co. Ltd.). It was found to be 117 nm.

[Production of Toner Mother Particles 1]

Into a reaction vessel equipped with a stirrer, a temperature sensor and a cooling tube were placed 300 mass parts (in terms of solid content) of styrene-acrylic resin particle dispersion liquid, 2,000 mass parts of ion-exchanged water. Then, a 5 (mol/L) sodium hydroxide aqueous solution was added to adjust the pH to 10. Thereafter 40 mass parts (in terms of solid content) of colorant dispersion liquid was placed in the reaction vessel. Next, an aqueous solution of 60 mass parts of magnesium chloride dissolved in 60 mass parts of ion-exchanged water was added with stirring at 30° C. over 10 minutes. The mixture was left still for 3 minutes. Thereafter, the temperature was raised to 80° C. over 60 minutes, and the grain growth reaction was continued while maintaining 80° C. In this condition, the particle size of the associated particles was measured by using a "MULTISIZER 3" (Beckman Coulter, Inc.). When the volume-based median diameter ($D_{50}$) reached 5.6 μm, 30 mass parts (in terms of solid content) of dispersion liquid of amorphous polyester resin particles were added over 30 minutes. When the supernatant of the reaction solution became transparent, an solution prepared by dissolving 190 mass parts of sodium chloride in 760 mass of ion-exchanged water was added to terminate particle growth. Then, the reaction system was further heated to 90° C. and stirred to allow fusion of the particles to proceed. When the average circularity of the toner reached 0.950 measured by a measuring apparatus of toner average circularity "FPIA-2100" (manufactured by Sysmex Corporation. HPF detection number of 4000), the reaction system was cooled to 30° C. to obtain a dispersion liquid of toner mother particles.

The obtained dispersion liquid of toner mother particles was subjected to solid-liquid separation using a centrifuge. A wet cake of the toner mother particles was formed. This wet cake was washed with ion-exchanged water at 35° C. with the same centrifuge until the electric conductivity of the filtrate reached 5 μS cm. Thereafter, it was transferred to a flash jet dryer (manufactured by Seishin Enterprise Co., Ltd.) and dried until the water content reached 0.5 mass %. Thus toner mother particles 1 were produced. The produced toner mother particles 1 had an average particle size of 5.9 μm and an average circularity of 0.955.

[Production of Toner Mother Particles 2]

Into a reaction vessel equipped with a stirrer, a temperature sensor and a cooling tube were placed 250 mass parts (in terms of solid content) of styrene-acrylic resin particle dispersion liquid, 2,000 mass parts of ion-exchanged water. Then, a 5 (mol/L) sodium hydroxide aqueous solution was added to adjust the pH to 10. Thereafter 40 mass parts (in terms of solid Content) of colorant dispersion liquid [A] were placed in the reaction vessel. Next, an aqueous solution of 60 mass parts of magnesium chloride dissolved in 60 mass parts of ion-exchanged water was added with stirring at 30° C. over 10 minutes. The mixture was left still for 3 minutes. Thereafter, the temperature was raised to 80° C. over 60 minutes, and the grain growth reaction was continued while maintaining 80° C. In this condition, the particle size of the associated particles was measured by using a "MULTISIZER 3" (Beckman Coulter, Inc.). When the volume-based median diameter ($D_{50}$) reached 6.0 μm, an aqueous solution prepared by dissolving 190 mass parts of sodium chloride in 760 mass of ion-exchanged water was added to terminate particle growth. Then, the reaction system was further heated to 90° C. and stirred to allow fusion of the particles to proceed. When the average circularity of the toner reached 0.960 measured by a measuring apparatus of toner average circularity "FPIA-2100" (manufactured by Sysmex Corporation, HPF detection number of 4000), the reaction system was cooled to 30° C. to obtain a dispersion liquid of toner mother particles.

The obtained dispersion liquid of toner mother particles was subjected to solid-liquid separation using a centrifuge. A wet cake of the toner mother particles was formed. This wet cake was washed with ion-exchanged water at 35° C. with the same centrifuge until the electric conductivity of the filtrate reached 5 μS cm. Thereafter, it was transferred to a flash jet dryer (manufactured by Seishin Enterprise Co., Ltd,) and dried until the water content reached 0.5 mass %. Thus toner mother particles 2 were produced. The produced toner mother particles 2 had an average particle size of 6.2 μm and an average circularity of 0.961.

[Production of Toner Mother Particles 3]

Into a reaction vessel equipped with a stirrer, a temperature sensor and a cooling tube were placed 250 mass parts (in terms of solid content) of dispersion liquid of amorphous polyester particles, 25 mass parts (in terms of solid content) of releasing agent dispersion liquid, and 2,000 mass parts of ion-exchanged water. Then, a 5 (mol/L) sodium hydroxide aqueous solution was added to adjust the pH to 10. Thereafter 40 mass parts (in terms of solid content) of colorant dispersion liquid [A] were placed in the reaction vessel. Next, an aqueous solution of 60 mass parts of magnesium chloride dissolved in 60 mass pans of ion-exchanged water was added with stirring at 30° C. over 10 minutes. The mixture was left still for 3 minutes. Thereafter, the temperature was raised to 80° C. over 60 minutes, and the grain growth reaction was continued while maintaining 80° C. In this condition, the particle size of the associated particles was measured by using a "MULTISIZER 3" (Beckman Coulter, Inc.). When the volume-based median diameter ($D_{50}$) reached 5.8 μm, an aqueous solution prepared by dissolving 190 mass parts of sodium chloride in 760 mass of ion-exchanged water was added to terminate particle growth. Then, the reaction system was further heated to 90° C. and stirred to allow fusion of the particles to proceed. When the average circularity of the toner reached 0.947 measured by a measuring apparatus of toner average circularity "FPIA-2100" (manufactured by Sysmex Corporation, HPF detection number of 4000), the reaction system was cooled to 30° C. to obtain a dispersion liquid of toner mother particles.

The obtained dispersion liquid of toner mother particles was subjected to solid-liquid separation using a centrifuge. A wet cake of the toner mother particles was formed. This wet cake was washed with ion-exchanged water at 35° C. with the same centrifuge until the electric conductivity of the filtrate reached 5 μS cm. Thereafter, it was transferred to a flash jet dryer (manufactured by Seishin Enterprise Co., Ltd.) and dried until the water content reached 0.5 mass %. Thus toner mother particles 3 were produced. The produced toner mother particles 3 had an average particle size of 6.1 82 m and an average circularity of 0.954.

[Production of Toner Particles 1]

To the toner mother particles 1 produced above were added: 0.5 mass % of large size silica particles (HMDS treatment, hydrophobicity of 72, number average primary particle diameter of 110 nm); 0.5 mass % of small size silica particles (HMDS treatment, hydrophobicity of 67, number average primary particle diameter of 12 nm); and 0.8 mass % of alumina particles 1. The mixture was placed in a HENSCHEL MIXER model "FM 20C/I" (manufactured by Nippon Coke & Engineering Co., Ltd.) with setting the rotation number so that the blade tip circumferential speed was 40 m/s, and stirred for 20minutes to obtain toner particles 1 containing the toner mother particles 1 treated with external additives. Further, the temperature at the time of mixing external additives was set to be 40° C.±1° C. When the temperature became 41° C., cooling water was flowed into the outer bath of the HENSCHEL MIXER at a flow rate of 5 L/min, and when the temperature became 39° C., the cooling water was flowed at a flow rate of 1 L/min. Thus, temperature control inside the Henschel mixer was carried out. Thus the toner particles 1 were produced.

[Production of Toner Particles 2 to 19]

As indicated in Table II, toner particles 2 to 19 were prepared by changing the type of toner mother particles and the kind of external additive in the toner particle 1. In the toner particles 16, no alumina particles were added and titania particles (treated with octyltrimethoxysilane, hydrophobicity of 75, number average primary particle diameter of 25 rim) were used.

TABLE II

| | Toner mother | | External additive | | | | | | | | |
|---|---|---|---|---|---|---|---|---|---|---|---|
| | | | Alumina particles | | | Small sized silicaparticles | | Large sized silica particles | | Titania particles | |
| | Particle | | | | Added | | Added | | Added | | Added |
| Toner No. | No. | Binder resin | No. | *1 (nm) | amount (mass %) | *1 (nm) | amount (mass %) | *1 (nm) | amount (mass %) | *1 (nm) | amount (mass %) |
| 1 | 1 | StAc + PEs | 1 | 20 | 0.8 | 12 | 0.8 | 110 | 0.5 | | — |
| 2 | 1 | StAc + PEs | 2 | 5 | 0.8 | 12 | 0.8 | 110 | 0.5 | — | — |
| 3 | 1 | StAc + PEs | 3 | 10 | 0.4 | 12 | 0.8 | 110 | 0.5 | — | — |
| 4 | 1 | StAc + PEs | 4 | 40 | 1.2 | 12 | 0.8 | 110 | 0.5 | — | — |
| 5 | 1 | StAc + PEs | 5 | 60 | 0.8 | 12 | 0.8 | 110 | 0.5 | — | — |
| 6 | 1 | StAc + PEs | 6 | 20 | 0.8 | 12 | 0.8 | 110 | 0.5 | — | — |
| 7 | 1 | StAc + PEs | 7 | 20 | 0.8 | 12 | 0.8 | 110 | 0.5 | — | — |
| 8 | 1 | StAc + PEs | 8 | 20 | 0.8 | 12 | 0.8 | 110 | 0.5 | — | — |
| 9 | 1 | StAc + PEs | 9 | 20 | 0.8 | 12 | 0.8 | 110 | 0.5 | — | — |
| 10 | 1 | StAc + PEs | 10 | 10 | 0.4 | 12 | 0.8 | 110 | 0.5 | — | — |
| 11 | 1 | StAc + PEs | 11 | 20 | 0.8 | 12 | 0.8 | 110 | 0.5 | — | — |
| 12 | 2 | StAc | 1 | 20 | 0.8 | 12 | 0.8 | 110 | 0.5 | — | — |
| 13 | 3 | PEs | 1 | 20 | 0.8 | 12 | 0.8 | 110 | 0.5 | — | — |
| 14 | 1 | StAc + PEs | 1 | 20 | 1.0 | 12 | 1.2 | — | — | — | — |
| 15 | 1 | StAc + PEs | 1 | 20 | 0.8 | — | — | — | — | — | — |
| 16 | 1 | StAc + PEs | — | — | — | 12 | 0.6 | — | — | 25 | 0.8 |
| 17 | 1 | StAc + PEs | 12 | 70 | 1.2 | 12 | 0.8 | 110 | 0.5 | — | — |
| 18 | 1 | StAc + PEs | 13 | 20 | 0.8 | 12 | 0.8 | 110 | 0.5 | — | — |
| 19 | 1 | StAc + PEs | 14 | 20 | 0.8 | 12 | 0.8 | 110 | 0.5 | — | — |

StAc: Styrene-Acrylic resin
PEs: Polyester resin
*1: Number average primary particle diameter

[Production of Carrier Particles]

<Production of Carrier Material Particles 1>

Raw materials were weighed so that MnO: 35 mol %, MgO: 14.5 mol %, Fe 2 O 3: 50 mol % and SrO: 0.5 mol %. After mixing the raw materials with water, a slurry was obtained by pulverizing with a wet media mill for 5 hours. The obtained slurry was dried with a spray drier to obtain spherical particles. After controlling the particle size of these particles, they were heated at 950° C. for 2 hours and pre bared. After grinding with a wet ball mill using stainless steel beads having a diameter of 0.3 cm for 1 hour, the mixture was pulverized for 4 hours using zirconia beads having a diameter of 0.5 cm. PVA as a binder was added in an amount of 0.8% mass % based on the solid content, then granulated and dried with a spray drier, and the mixture was held in an electric furnace at a temperature of 1350° C. for 5 hours for main sintering. Thereafter, the mixture was disintegrated, further classified to adjust the particle size, and thereafter, the low magnetic force products were separated by magnetic power drilling to obtain carrier core material particles 1. The average particle diameter of the carrier core material particles 1 was 35 μm.

(Production of Core Material Covering Resin 1)

Into a 0.3 mass % aqueous solution of sodium benzenesulfonate were added cyclohexyl methacrylate and methyl methacrylate at a "mass ratio=5:5" (copolymerization ratio). Potassium persulfate in an amount corresponding to 0.5 mass % of the total amount of the monomers was added to the mixture to perform emulsion polymerization. The reaction mixture was dried by spray drying to prepare "covering material 1". The weight average molecular weight of the obtained covering material 1 was 500,000.

(Production of Carrier Particles 1)

100 mass parts of the "carrier core material particles 1" prepared above as core particles and 4.5 mass pails of "covering material 1" were placed in a high-speed stirring mixer equipped with horizontal stirring blades. After mixing and stirring at 22° C. for 15 minutes under the condition that the circumferential velocity of the horizontal rotary impeller is 8 m/sec, the mixture was mixed at 120° C. for 50 minutes. Thereby, a resin covering layer was formed on the surface of the core material particles by the action of a mechanical impact force (mechanochemical method) to produce "carrier particles 1". The resistance value of the carrier particles [1] was $9.0\times10^{9}$ Ω·cm.

(Measuring Method of Resistance of the Carrier Particles)

The resistance value of the carrier particles according to the present invention is a resistance that is dynamically measured under the developing condition by the magnetic brush. An aluminum electrode drum having the same size as the photosensitive drum was replaced with the photosensitive drum. Then, the carrier particles were supplied onto the developing sleeve to form a magnetic brush. The formed magnetic brush was rubbed against the electrode drum. A voltage (500 V) was applied between the developing sleeve and the electrode drum to measure the current that flows therebetween. The resistance of the carrier particles was obtained by the following expression.

$$DVR(\Omega\cdot cm)=(V/I)\times(N\times L/Dsd)$$

In the aforesaid expression, the symbols indicate the following.

DVR: Resistance of carrier particles (Ω·cm)

V: Voltage between the developing sleeve and the electrode drum (V)

I: Measured electric current (A)

N: Developing nip width (cm)

L: Developing sleeve length (cm)

Dsd: Distance between the developing sleeve and the electrode drum (cm)

In the present invention, the measurement was done with the conditions of: V=500V, N=1 cm, L=6 cm, and Dsd=0.6 mm.

(Production of Carrier Particles 2 to 10)

Carrier particles 2 to 10 were produced by changing the composition ratio (mass ratio) of the resin covering layer in the production of carrier particles 1 as indicated in Table III. In the carrier particles 9, the resin covering layer was formed only with the silicone resin.

TABLE III

| Carrier particle No. | Constitution ratio of resin covering layer (mass ratio) | Resistance value of carrier particles (Ω · cm) |
|---|---|---|
| 1 | CHMA:MMA = 5:5 | $9.0 \times 10^{9}$ |
| 2 | CHMA:MMA = 3:7 | $7.1 \times 10^{9}$ |
| 3 | CHMA:MMA = 8:2 | $1.1 \times 10^{10}$ |
| 4 | CHMA:MMA = 5:5 | $1.7 \times 10^{9}$ |
| 5 | CHMA:MMA = 5:5 | $7.2 \times 10^{10}$ |
| 6 | CHMA:MMA:St = 4:2:4 | $5.2 \times 10^{9}$ |
| 7 | CHMA:St = 5:5 | $6.3 \times 10^{10}$ |
| 8 | MMA:St = 5:5 | $1.1 \times 10^{9}$ |
| 9 | Silicone resin | $1.0 \times 10^{11}$ |
| 10 | CHA:MMA = 5:5 | $5.1 \times 10^{9}$ |

CHMA: Cyclohexyl methacrylate
MMA: Methyl methacrylate
St: Styrene
CHA: Cyclohexyl acrylate <Production of Developer>

(Production of Developer 1)

The toner particles 1 and the carrier particles 1 prepared as described above were mixed with each other so that the toner concentration was 5 mass % to prepare a developer 1, and the following evaluation was made. A V-type mixer was used as a mixer, and mixing was done for 30 minutes.

(Production of Developers 2 to 28)

Developers 2 to 28 were prepared by changing the combination of the toner and the carrier in the preparation method of the developer 1 as indicated in Table IV.

<Evaluation>

The following evaluations were made using each of the above-described developers. A commercially available color multi-functional peripheral (MFP) "BIZHUB PRO C6500" (manufactured by Konica Minolta, Inc.) was used as an image forming apparatus. Under a normal temperature and normal humidity environment (temperature 20° C., humidity 50% RH), 1,000 sheets of printings having a belt-like solid image with a printing rate of 5% as a test image were performed on A4 size high quality paper (65 g/m$^2$). Then, under a high temperature and high humidity environment (temperature 30° C., humidity 80% RH), 70,000 sheets of printings having a belt-like solid image with a printing rate of 5% as a test image were performed. Under the same conditions, 30,000 sheets of printings having a belt-like solid image with a printing rate of 40% were performed. Further, under a low temperature and low humidity environment (temperature 10° C., humidity 20% RH), 70,000 sheets of printings having belt-like solid image with a printing rate of 5% as a test image were performed. Under the same conditions, 30,000 sheets of printings having a belt-like solid image with a printing rate of 40% were performed.

With respect to the image forming apparatus and evaluation image after printing 1,000 sheets, 101,000 sheets, and 201,000 sheets, the following evaluations were performed. Each evaluation result is listed in Table IV.

(Evaluation of Charge Amount)

The charge amount of the toner was measured with a charge amount measuring apparatus "Blow off type TB-200" (manufactured by Toshiba Co, Ltd.). A400 mesh stainless steel screen was attached to the image forming apparatus and blown with nitrogen gas for 10 seconds under a blow pressure of 0.5 kgf/cm$^2$. The charge amount (μC/g) was calculated by dividing the measured charge by the flying toner mass.

(Evaluation of Image Density)

Image densities of 20 places in the solid :image area were measured, and the average value of these values was taken as the image density. The image density was measured with a reflection densitometer RD-918 manufactured by Macbeth Corporation. The measured image density is an absolute density.

(Evaluation of Fog)

First, absolute image densities of 20 places were measured using, a MACBETH REFLECTION DENSITOMETER "RD-918" for blank paper that was not printed and averaged to obtain blank paper density. Next, absolute image densities of 20 blank areas of each evaluation image were similarly measured and averaged, and a value obtained by subtracting the blank paper density from this average density was evaluated as fog density. Evaluation was carried out according to the following criteria.

○: Fog density is 0.007 or less

Δ: Fog density is larger than 0.007 and not more than 0.010 x : Fog density is 0.011 or more (Evaluation Dot Reproducibility)

An evaluation image print having a gradation patter of 32 gradation levels was outputted. Fourier transformation processing in which MTF (Modulation Transfer Function) correction was taken into account was applied to the reading value of the gradation pattern by the CCD. GI value (Graininess Index) according to human relative visibility was measured, and the maximum graininess was determined. The smaller the GI value is, the better it is, and the smaller the GI value, the lower the graininess of the image is. This GI value is the value disclosed in the Journal of the Imaging Society of Japan 39 (2), 84-93 (2000). The graininess of the gradation pattern in the image was evaluated according to the following evaluation criteria ○: Maximum GI value in the image print is 0.170 or less Δ: Maximum GI value in the image print is larger than 0.170 and not more than 0.180 x : Maximum GI value in the image print is larger than 0.180

TABLE IV

| Developer No. | Toner No. | Carrier particle No. | Evaluation: Charge amount (μC/g) *1 | *2 | *3 | Image density *1 | *2 | *3 | Fog | Dot reproducibility | Remarks |
|---|---|---|---|---|---|---|---|---|---|---|---|
| 1 | 1 | 1 | 49.0 | 42.1 | 53.8 | 1.28 | 1.31 | 1.27 | ○ | ○ | Present invention |
| 2 | 2 | 1 | 43.1 | 38.2 | 51.1 | 1.30 | 1.28 | 1.27 | ○ | Δ | Present invention |
| 3 | 3 | 1 | 45.0 | 39.9 | 52.0 | 1.30 | 1.29 | 1.26 | ○ | ○ | Present invention |
| 4 | 4 | 1 | 49.6 | 41.8 | 52.6 | 1.30 | 1.28 | 1.28 | ○ | ○ | Present invention |
| 5 | 5 | 1 | 51.0 | 42.1 | 53.0 | 1.29 | 1.38 | 1.37 | ○ | Δ | Present invention |
| 6 | 6 | 1 | 40.0 | 33.3 | 45.2 | 1.30 | 1.31 | 1.37 | Δ | Δ | Present invention |
| 7 | 7 | 1 | 53.5 | 44.1 | 58.2 | 1.30 | 1.33 | 1.40 | Δ | Δ | Present invention |
| 8 | 8 | 1 | 51.2 | 45.5 | 58.2 | 1.29 | 1.31 | 1.27 | ○ | ○ | Present invention |
| 9 | 9 | 1 | 53.4 | 45.5 | 60.8 | 1.30 | 1.32 | 1.37 | Δ | ○ | Present invention |
| 10 | 10 | 1 | 45.5 | 38.0 | 54.3 | 1.29 | 1.33 | 1.27 | ○ | ○ | Present invention |
| 11 | 11 | 1 | 44.6 | 37.5 | 55.0 | 1.28 | 1.31 | 1.27 | ○ | ○ | Present invention |
| 12 | 12 | 1 | 46.6 | 39.2 | 56.5 | 1.30 | 1.34 | 1.27 | ○ | ○ | Present invention |
| 13 | 13 | 1 | 49.0 | 34.8 | 55.6 | 1.27 | 1.35 | 1.24 | ○ | Δ | Present invention |
| 14 | 14 | 1 | 52.4 | 46.0 | 61.1 | 1.27 | 1.37 | 1.20 | Δ | Δ | Present invention |
| 15 | 15 | 1 | 45.0 | 35.0 | 53.0 | 1.30 | 1.39 | 1.20 | Δ | Δ | Present invention |
| 16 | 16 | 1 | 53.0 | 45.5 | 62.1 | 1.28 | 1.50 | 1.52 | X | X | Comparative example |
| 17 | 17 | 1 | 41.1 | 28.0 | 51.1 | 1.30 | 1.48 | 1.43 | X | X | Comparative example |
| 18 | 18 | 1 | 49.8 | 31.3 | 50.0 | 1.28 | 1.50 | 1.55 | X | X | Comparative example |
| 19 | 1 | 2 | 46.5 | 39.9 | 51.2 | 1.29 | 1.33 | 1.30 | ○ | ○ | Present Invention |
| 20 | 1 | 3 | 49.8 | 44.4 | 58.0 | 1.27 | 1.29 | 1.27 | ○ | ○ | Present invention |
| 21 | 1 | 4 | 41.1 | 34.8 | 50.0 | 1.30 | 1.33 | 1.29 | Δ | ○ | Present invention |
| 22 | 1 | 5 | 52.2 | 46.6 | 60.8 | 1.29 | 1.29 | 1.24 | ○ | ○ | Present invention |
| 23 | 1 | 6 | 45.6 | 38.3 | 56.0 | 1.29 | 1.33 | 1.27 | ○ | ○ | Present invention |
| 24 | 1 | 7 | 51.0 | 42.1 | 59.2 | 1.27 | 1.35 | 1.24 | Δ | Δ | Present invention |
| 25 | 1 | 8 | 46.6 | 33.3 | 55.5 | 1.30 | 1.48 | 1.49 | X | X | Comparative example |
| 26 | 1 | 9 | 44.0 | 23.3 | 50.1 | 1.30 | 1.53 | 1.55 | X | X | Comparative example |
| 27 | 1 | 10 | 45.5 | 38.5 | 52.8 | 1.29 | 1.33 | 1.29 | Δ | Δ | Present invention |
| 28 | 19 | 1 | 45.6 | 39.9 | 53.8 | 1.29 | 1.32 | 1.27 | ○ | ○ | Present invention |

*1: After printing 1,000 sheets
*2: After printing 101,000 sheets
*3: After printing 201,000 sheets As demonstrated in Table IV, even when there is environmental fluctuation in temperature or humidity during image formation or when coverage (printing rate) varies, the developer of the present invention (two-component developer for developing an electrostatic latent image), it was found that fluctuation in the charge amount of the toner can be suppressed. When the developer of the present invention was used, it was also found that the evaluation items of the image density, the fog and the dot reproducibility described above were also excellent. Therefore, it was found that, in the image formation using the developer of the present invention, a high quality image can be obtained over a long period of time. In contrast, the comparative developer (two-component developer for developing an electrostatic latent image) was inferior to any of the evaluation items.

What is claimed is:

1. A two-component developer for developing an electrostatic latent image comprising: toner particles having toner mother particles and an external additive on a surface of the toner mother particles; and carrier particles, wherein the external additive contains alumina particles;

the alumina particles are subjected to a surface modification with a hydrophobilizing agent;

among the hydrophobilizing agent existing on the surface of the alumina particles after the surface modification, a ratio of the hydrophobilizing agent in a state of being liberated from the surface is 20% or less when extraction treatment is performed under a predetermined condition;

the alumina particles have a number average primary particle diameter in the range of 5 to 60 nm;

the carrier particles have a resin covering layer, and the resin covering layer is formed with an alicyclic (meth)acrylate monomer; and a total amount of carbon derived from the hydrophobilizing agent present on the surface of the alumina particles after surface modification is in the range of 0.5 to 10 mass % based on the alumina particles after surface modification.

2. The two-component developer for developing an electrostatic latent image described in claim 1, wherein a content of the alumina particles is in the range of 0.1 to 2.0 mass parts with respect to 100 mass parts of the toner particles.

3. The two-component developer for developing an electrostatic latent image described in claim 1, wherein the external additive further contains silica particles having a number average primary particle diameter in the range of 10 to 60 nm.

4. The two-component developer for developing an electrostatic latent image described in claim 3, wherein the external additive further contains silica particles having a number average primary particle diameter in the range of 80 to 150 nm.

5. The two-component developer for developing an electrostatic latent image described in claim 1, wherein the resin covering layer comprises a copolymer obtained by polymerizing the alicyclic (meth)acrylate monomer and a methyl methacrylate monomer.

6. The two-component developer for developing an electrostatic latent image described in claim 1, wherein the carrier particles have a resistance in the range of $1.0\times10^{9}$ to $1.0\times10^{11}$ Ω·cm.

7. The two-component developer for developing an electrostatic latent image described in claim 1, wherein the toner particles have a volume average particle diameter of 3.0 to 6.5 μm.

8. The two-component developer for developing an electrostatic latent image described in claim 1, wherein the toner particles contain a vinyl resin as a binder resin that constitutes the toner particles.

9. The two-component developer for developing an electrostatic latent image described in claim 8, wherein the toner particles further contain a polyester resin as a binder resin that constitutes the toner particles.

* * * * *